US009811104B2

(12) United States Patent
Doorenbos

(10) Patent No.: US 9,811,104 B2
(45) Date of Patent: Nov. 7, 2017

(54) REFERENCE VOLTAGE GENERATOR SYSTEM FOR REDUCING NOISE

(71) Applicant: TEXAS INSTRUMENTS INCORPORATED, Dallas, TX (US)

(72) Inventor: Jerry L. Doorenbos, Tucson, AZ (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 187 days.

(21) Appl. No.: 14/644,788

(22) Filed: Mar. 11, 2015

(65) Prior Publication Data

US 2015/0261246 A1 Sep. 17, 2015

Related U.S. Application Data

(60) Provisional application No. 61/951,300, filed on Mar. 11, 2014.

(51) Int. Cl.

| | |
|---|---|
| ***G05F 3/02*** | (2006.01) |
| ***G05F 3/20*** | (2006.01) |
| ***G05F 3/30*** | (2006.01) |
| *G05F 3/22* | (2006.01) |

(52) U.S. Cl.

CPC ..... *G05F 3/02* (2013.01); *G05F 3/205* (2013.01); *G05F 3/30* (2013.01); *G05F 3/225* (2013.01)

(58) Field of Classification Search

CPC ... G05F 3/02; G05F 3/30; G05F 3/205; G05F 3/225

USPC ..... 327/537, 539; 323/268, 313

See application file for complete search history.

(56) References Cited

U.S. PATENT DOCUMENTS

| | | | | |
|---|---|---|---|---|
| 5,229,711 | A * | 7/1993 | Inoue | G05F 3/30 323/313 |
| 7,453,252 | B1 * | 11/2008 | Megaw | G05F 3/30 323/313 |
| 2004/0257150 | A1 * | 12/2004 | Farooqui | G05F 3/30 327/539 |
| 2008/0297131 | A1 * | 12/2008 | Peng | G05F 3/30 323/313 |
| 2012/0206192 | A1 * | 8/2012 | Fletcher | G05F 3/30 327/539 |

* cited by examiner

*Primary Examiner* — Jue Zhang
*Assistant Examiner* — Jye-June Lee
(74) *Attorney, Agent, or Firm* — John R. Pessetto; Charles A. Brill; Frank D. Cimino

(57) ABSTRACT

One example includes an reference voltage generator system. The system includes an amplifier configured to generate a reference voltage based on a respective input voltage provided at each of at least one input of the amplifier. The system also includes at least one input transistor that is coupled to the at least one input of the amplifier and is statically-biased to conduct a current to set an amplitude of the respective input voltage provided at each of the at least one input of the amplifier. Each of the at least one input transistor includes an input terminal that is coupled in series with an input resistor.

20 Claims, 3 Drawing Sheets

REFERENCE VOLTAGE GENERATOR SYSTEM FOR REDUCING NOISE

CROSS-REFERENCE TO RELATED APPLICATION

This application claims the benefit of U.S. Provisional Patent Application No. 61/951,300, filed Mar. 11, 2014, and entitled "METHOD FOR FLICKER AND BURST NOISE REDUCTION AND BASE CURRENT CORRECTION IN BAND GAP REFERENCE CIRCUIT", which is incorporated herein by reference in its entirety.

TECHNICAL FIELD

This disclosure relates to a reference voltage generator system.

BACKGROUND

Amplifier circuits can be implemented in a variety of applications. One example is a reference voltage generator system (e.g., a bandgap reference voltage system) that can be implemented to generate a substantially stable reference voltage for a variety of circuit applications. Reference voltage generator systems can typically implement an arrangement of transistors and/or resistors to set an input voltage at an amplifier, with the amplifier generating the reference voltage. For example, reference voltage generator systems can be configured in a variety of processes, such as complementary metal-oxide semiconductor (CMOS) processes, and can include optimized arrangements of transistors and resistors. However, resistors that are implemented to set the input voltage for the amplifier can typically contribute to thermal noise in the generation of the reference voltage. Similarly, the transistors can likewise contribute to a number of noise sources, such as thermal noise, shot noise, flicker noise, and/or burst noise. Such noise sources can contribute to a degradation of stability of the reference voltage.

SUMMARY

One example includes a reference voltage generator system. The system includes an amplifier configured to generate a reference voltage based on a respective input voltage provided at each of at least one input of the amplifier. The system also includes at least one input transistor that is coupled to the at least one input of the amplifier and is statically-biased to conduct a current to set an amplitude of the respective input voltage provided at each of the at least one input of the amplifier. Each of the at least one input transistor includes an input terminal that is coupled in series with an input resistor.

Another example includes a circuit. The circuit includes an amplifier configured to generate a reference voltage based on a respective input voltage provided at each of at least one input of the amplifier. The circuit further includes at least one input transistor that is coupled to the at least one input of the amplifier and is statically-biased to conduct a current to set an amplitude of the respective input voltage provided at each of the at least one input of the amplifier. Each of the at least one input transistor includes an input terminal that is coupled in series with an input resistor. The input resistor can have a resistance value that is selected based on an error term of a current associated with the input terminal of the respective at least one transistor. The current associated with the input terminal can be associated with an activation voltage of the at least one transistor to set the amplitude of the respective input voltage.

Another example includes amplifier reference voltage generator system. The system includes an amplifier configured to generate a reference voltage based on a respective input voltage provided at each of at least one input of the amplifier. The system also includes at least one input bipolar junction transistor (BJT) that is coupled to the at least one input of the amplifier and is statically-biased to conduct a current to set an amplitude of the respective input voltage provided at each of the at least one input of the amplifier. Each of the at least one input BJT includes an input resistor interconnecting a base and a collector of the respective at least one input BJT. The system further includes at least one feedback circuit component associated with a feedback arrangement of the amplifier to set the amplitude of the at least one input voltage. The at least one feedback circuit component can be fabricated as a matched component of the at least one input resistor or of an output transistor that is controlled via the amplifier, such that the reference voltage is approximately insensitive to temperature variation.

DETAILED DESCRIPTION

This disclosure relates generally to electronic circuits, and more specifically to a reference voltage generator system. The circuit system can include an amplifier configured to generate a reference voltage based on a feedback arrangement based on at least one input voltage at an input of the amplifier. Additionally, the reference voltage generator system can include an arrangement of resistors and input transistors, such as bipolar junction transistors (BJTs), that can be implemented to set an amplitude of the input voltage(s) at the input of the amplifier. As an example, the input transistors can be statically biased, such as based on being diode-connected. Additionally, to provide an amplitude of the reference voltage that is substantially stable, such as based on mitigation of noise sources (e.g., thermal noise, burst noise, and/or flicker noise), the input transistors can include an input resistor coupled in series at an input terminal (e.g., a base) of the respective input transistor to mitigate errors associated with the respective noise sources.

For example, the input resistor can have a resistance value that is selected based on an error term associated with an input current (e.g., base current) of the respective input transistor. The input current can be associated with an activation voltage of the input transistor(s) that sets the amplitude of the respective input voltage of the amplifier. Therefore, the resistance value of the resistor can be selected to mitigate the error term, such that the activation voltage of the input transistor can be substantially more stable to provide a respective voltage across the input transistor(s) that can likewise be substantially more stable. Accordingly, the reference voltage generated by the amplifier can be generated at a substantially more stable amplitude. The reference voltage generator system can be implemented in a variety of ways, such as based on a variety of feedback arrangements and/or arrangements of the input transistor(s).

Figure 1:
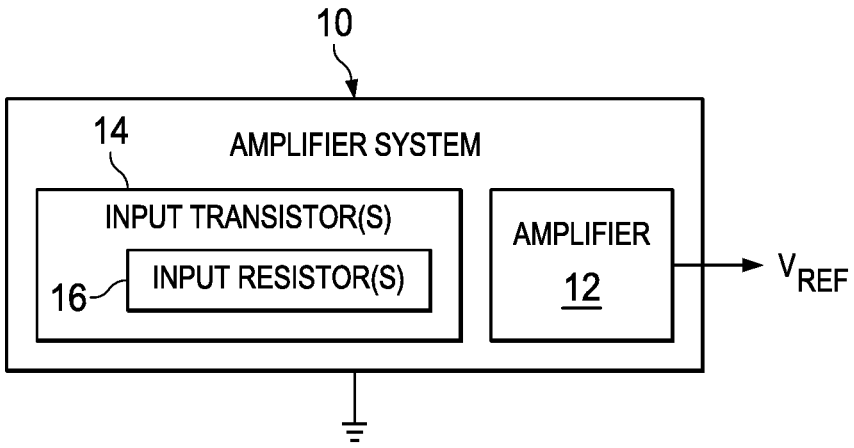
FIG. 1 illustrates an example of a reference voltage generator system.

FIG. 1 illustrates an example of an reference voltage generator system 10. The reference voltage generator system 10 can be implemented as a reference voltage generator system, such as implemented in a variety of circuit applications (e.g., as a bandgap voltage generator) to generate a substantially stable reference voltage $V_{REF}$. As an example, the reference voltage generator system 10 can be formed as or as part of an integrated circuit (IC) chip. The reference voltage generator system 10 includes an amplifier 12 (e.g., an operational amplifier (OP-AMP)) that is configured to generate the reference voltage $V_{REF}$ at an output based on an input voltage provided to at least one input of the amplifier 12. The input voltage can be set based on a feedback arrangement of the amplifier 12 in a variety of ways. Additionally, the reference voltage generator system 10 includes at least one input transistor 14 that is likewise configured to set an amplitude of the input voltage at the respective input(s) of the amplifier 12. As described herein, the term "transistor" describes one or more transistor devices arranged to function as a transistor. For example, each of the input transistor(s) 14 can be arranged as a bipolar junction transistor (BJT) that is diode-connected based on having a base coupled to a collector (e.g., via an interconnecting input resistor, as described in greater detail herein), and is thus statically biased. As described herein, the term "statically biased" refers to an arrangement of the input transistor(s) 14 in which the activation of respective input transistor(s) 14 is unaffected by dynamic external signals, and is thus configured to maintain a substantially consistent activation to maintain a substantially stable and static current flow through the respective input transistor(s) 14, and thus a substantially stable and static resistance across the respective input transistor(s) 14. One example of a statically biased transistor is a diode-connected transistor. As used herein, the term "substantially" is intended to convey that although an effect or result is intended, in practice, there may be a small amount of variation, such as due to component tolerances and/or processing variations. As described herein, the reference voltage generator system 10 can be arranged in a variety of ways with respect to the feedback arrangement of the amplifier 12 and the input transistor(s) 14.

In the example of FIG. 1, each of the input transistor(s) 14 includes an input resistor 16 that is coupled in series with an input terminal of the respective input transistor(s) 14. As described herein, the term "resistor" refers to one or more resistive elements that provide a collective resistance. For example, the input resistor 16 can be coupled in series with a base of the input transistor(s) 14 that are configured as BJT(s), such as based on interconnecting the base and the collector of the diode-connected input transistor(s) 14. As an example, the input resistor 16 of each of the input transistor(s) 14 can have a resistance value that is selected based on an error term associated with an input current (e.g., base current) of the respective input transistor(s) 14. The input current can be associated with an activation voltage of the input transistor(s) 14 that sets the amplitude of the respective input voltage of the amplifier 12. Therefore, the resistance value of the resistor can be selected to mitigate the error term, such that the activation voltage of the input transistor can be substantially more stable to provide a respective voltage across the input transistor(s) 14 that can likewise be substantially more stable, such as based on mitigating sources of noise, such as thermal noise, flicker noise, and/or burst noise.

Figure 2:
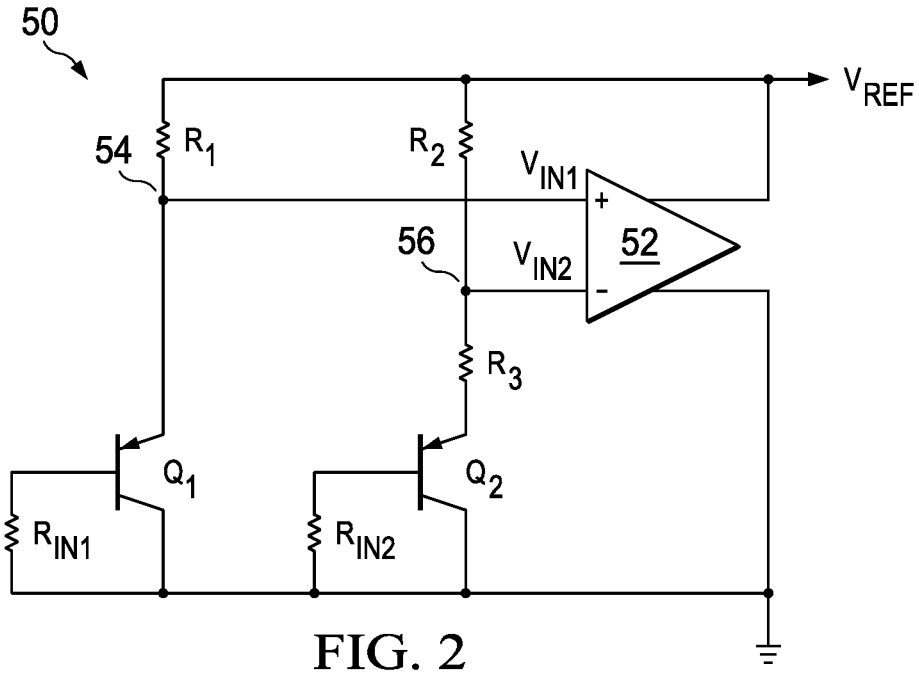
FIG. 2 illustrates an example of a reference voltage generator circuit.

FIG. 2 illustrates an example of a reference voltage generator circuit 50. The reference voltage generator circuit 50 can correspond to the reference voltage generator system 10, and is thus demonstrated as a first example of the reference voltage generator system 10.

The reference voltage generator circuit 50 includes an amplifier 52 arranged as an OP-AMP that is configured to generate the reference voltage $V_{REF}$ with reference to a low-voltage rail, demonstrated in the example of FIG. 2 as ground. The amplifier 52 receives a first input voltage $V_{IN1}$ on a node 54 at a non-inverting input and a second input voltage $V_{IN2}$ on a node 56 at an inverting input. The node 54 is arranged between a resistor $R_1$ and an emitter of a first input transistor $Q_1$, demonstrated in the example of FIG. 2 as a PNP-type BJT. The node 56 is arranged between a resistor $R_2$ and a resistor $R_3$, with the resistor $R_3$ interconnecting the node 56 and an emitter of a second input transistor $Q_2$, demonstrated in the example of FIG. 2 as a PNP-type BJT. The input transistors $Q_1$ and $Q_2$ each have collectors that are coupled to the low-voltage rail. As an example, the input transistors $Q_1$ and $Q_2$ can be substrate-coupled BJTs based on having a collector that is coupled to or forms a substrate of an associated IC chip, and can have sizes that differ with respect to each other to achieve a desired gain of the reference voltage $V_{REF}$. The resistors $R_1$ and $R_2$ interconnect the reference voltage $V_{REF}$ and the respective nodes 54 and 56. Therefore, the amplifier 52 is demonstrated in the example of FIG. 2 in a feedback arrangement, such that the reference voltage $V_{REF}$ provided at an output of the amplifier 52 is implemented to set the input voltages $V_{IN1}$ and $V_{IN2}$ at the respective inputs of the amplifier 52.

As an example, the reference voltage $V_{REF}$ can be generated as a bandgap voltage based on a summation of a $V_{be}$ voltage and a scaled difference of the $V_{be}$ voltages of the input transistors $Q_1$ and $Q_2$. The $V_{be}$ voltage can have a negative variation with increasing temperature, and the difference between the two $V_{be}$ voltages can have a positive variation with increasing temperature (e.g., proportional-to-absolute-temperature (PTAT)). Appropriate scaling of the difference between the two $V_{be}$ voltages of the input transistors $Q_1$ and $Q_2$ relative to the $V_{be}$ voltage in the summation can result in a substantially zero variation with respect to temperature variation. The difference in the $V_{be}$ voltages can be generated by choosing static biasing currents in the input transistors $Q_1$ and $Q_2$, such as to provide a constant ratio between operating current densities of the input transistors $Q_1$ and $Q_2$. For example, the constant ratio can be accomplished based on same magnitude bias currents in both of the input transistors $Q_1$ and $Q_2$ with one of the input transistors $Q_1$ and $Q_2$ having larger area than the other, both of the input transistors $Q_1$ and $Q_2$ having the same size but with a fixed ratio of bias current, or a combination thereof.

In the example of FIG. 2, the input transistors $Q_1$ and $Q_2$ are each demonstrated as diode-connected, such that the base of each of the input transistors $Q_1$ and $Q_2$ are coupled to the collector of each of the input transistors $Q_1$ and $Q_2$ at the low-voltage rail. Therefore, the input transistors $Q_1$ and $Q_2$ are statically biased to provide a substantially static activation of the respective $Q_1$ and $Q_2$ to provide current flow through the input transistors $Q_1$ and $Q_2$. Additionally, in the example of FIG. 2, the input transistor $Q_1$ includes an input resistor $R_{IN1}$ that is coupled in series with the base to interconnect the base and the collector of the input transistor $Q_1$. Similarly, the input transistor $Q_2$ includes an input resistor $R_{IN2}$ that is coupled in series with the base to interconnect the base and the collector of the input transistor $Q_2$. Therefore, the diode-connection of the input transistors $Q_1$ and $Q_2$ is via the respective input resistors $R_{IN1}$ and $R_{IN2}$.

The amplitude of the input voltages $V_{IN1}$ and $V_{IN2}$ can thus depend on the resistance in series with the respective input transistors $Q_1$ and $Q_2$ the voltage across the input resistors $R_{IN1}$ and $R_{IN2}$, and the respective activation of the input transistors $Q_1$ and $Q_2$ to provide a current flow through the respective input transistors $Q_1$ and $Q_2$. The activation of the input transistors $Q_1$ and $Q_2$ is based on a emitter-base voltage $V_{eb}$ of the respective input transistors $Q_1$ and $Q_2$, defined as:

$$V_{eb} = V_T \ln\left[\frac{I_e - I_b}{I_s}\right] \quad \text{Equation 1}$$

$$V_{eb} = V_T \ln\left[\left(\frac{I_e}{I_s}\right)\left(1 - \frac{I_b}{I_e}\right)\right] = V_T\left[\ln\left(\frac{I_e}{I_s}\right) + \ln\left(1 - \frac{I_b}{I_e}\right)\right] \quad \text{Equation 2}$$

Where:

$V_T$ is a thermal voltage defined by k*T/q;

$I_e$ is an emitter current of the respective input transistor;

$I_b$ is a base current of the respective input transistor;

$I_c$ is a collector current of the respective input transistor; and $I_s$ is a saturation current of the respective input transistor.

As demonstrated in Equation 2, the emitter-base voltage $V_{eb}$ includes an error term associated with the base current $I_b$ based on the emitter-base voltage $V_{eb}$ being a function of the emitter current $I_e$ and the saturation current $I_s$. As a result, with the input resistors $R_{IN1}$ and $R_{IN2}$ being coupled in series with the base of the respective input transistors $Q_1$ and $Q_2$, the respective resistance value of the input resistors $R_{IN1}$ and $R_{IN2}$ can be selected based on the base current $I_b$ to calculate a sum of the emitter-base voltage $V_{eb}$ and the voltage drop of the respective one of the input resistors $R_{IN1}$ and $R_{IN2}$ to achieve an emitter-base voltage $V_{eb}$ that is a function of the emitter current $I_e$ and the saturation current $I_s$, as follows:

$$R_b = \frac{-V_T \ln\left[1 - \frac{I_b}{I_e}\right]}{I_b} \quad \text{Equation 3}$$

$$V_{ebr} = V_{eb} + I_b R_b = V_T \ln\left[\frac{I_e}{I_s}\right] + V_T \ln\left[1 - \frac{I_b}{I_e}\right] - \frac{I_b V_T \ln\left[1 - \frac{I_b}{I_e}\right]}{I_b} = V_T \ln\left[\frac{I_e}{I_s}\right] \quad \text{Equation 4}$$

By implementing the input resistors $R_{IN1}$ and $R_{IN2}$ in series with the base of the respective input transistors $Q_1$ and $Q_2$, the reference voltage generator circuit 50 can compensate for errors based on controlling the emitter current $I_e$ instead of the collector current $I_c$. Since the error term associated with the base current $I_b$ in the calculation of the emitter-base voltage $V_{eb}$ can contribute to error effects based on transistor β, base current shot noise, flicker noise, and/or burst noise, the error effects can be substantially mitigated based on controlling the emitter current $I_e$ instead of the collector current $I_c$ in response to implementing the input resistors $R_{IN1}$ and $R_{IN2}$. Accordingly, the inclusion of the input resistors $R_{IN1}$ and $R_{IN2}$ in the reference voltage generator circuit 50 can substantially mitigate noise (e.g., low-frequency noise) in the reference voltage $V_{REF}$, resulting in a more stable reference voltage $V_{REF}$.

It is to be understood that the implementation of the resistors $R_{IN1}$ and $R_{IN2}$ can be sufficient to substantially mitigate noise (e.g., low-frequency noise) over a large variation of transistor β associated with the input transistors $Q_1$ and $Q_2$, particularly with larger values of transistor β. Additionally, the emitter current $I_e$ of the input transistors $Q_1$ and $Q_2$ can be set to be proportional-to-absolute-temperature (PTAT). Additionally, the input resistors $R_{IN1}$ and $R_{IN2}$ can be fabricated as the same type of resistors as the resistors $R_1$, $R_2$, and $R_3$, and thus fabricated as matched components, such that the input resistors $R_{IN1}$ and $R_{IN2}$ and the resistors $R_1$, $R_2$, and $R_3$ can have approximately equal temperature coefficients. For example, the difference between the $V_{be}$ voltages of the input transistors $Q_1$ and $Q_2$ is across the resistor $R_3$ coupled between the input transistor $Q_2$ and the node 56 since the feedback configuration of the amplifier 52 can result in a very near zero voltage difference between the two inputs of the amplifier 52. The difference in the $V_{be}$ voltages can be scaled by the voltage divider formed by the resistors $R_2$ and $R_3$ such that the reference voltage $V_{REF}$ can be substantially constant with temperature. The resistor $R_1$ interconnecting the reference voltage $V_{REF}$ and the input transistor $Q_1$ can cause the current flow in the input transistors $Q_1$ and $Q_2$ to be approximately equal or to be scaled by the resistor ratio. As an example, the input transistors $Q_1$ and $Q_2$ can be scaled in size to generate the $V_{be}$ voltage difference. The biasing of the input transistors $Q_1$ and $Q_2$ can be set by a difference between the $V_{be}$ voltages impressed across a resistor (e.g., the resistor $R_6$ in FIG. 3) resulting in a PTAT/R current.

Additionally, the resistors $R_1$, $R_2$, and $R_3$ can be appropriately scaled in resistance value with respect to each other to provide a substantially constant amplitude of the reference voltage $V_{REF}$ with respect to temperature. Therefore, the emitter current $I_e$ can be provided in a PTAT/R manner, such that an effective resistance value of the respective input resistors $R_{IN1}$ and $R_{IN2}$ can be substantially constant as a function of temperature.

Furthermore, it is to be understood that the reference voltage generator circuit 50 is not limited to as demonstrated in the example of FIG. 2. For example, the feedback arrangement of the amplifier 52 is not limited to the use of the resistors $R_1$, $R_2$, and $R_3$, such as described in greater detail herein, but could implement a variety of other ways to generate the reference voltage $V_{REF}$ in the feedback arrangement. Additionally, the input transistors $Q_1$ and $Q_2$ can be implemented as NPN-type transistors instead of PNP-type transistors, as demonstrated in the example of FIG. 3.

Figure 3:
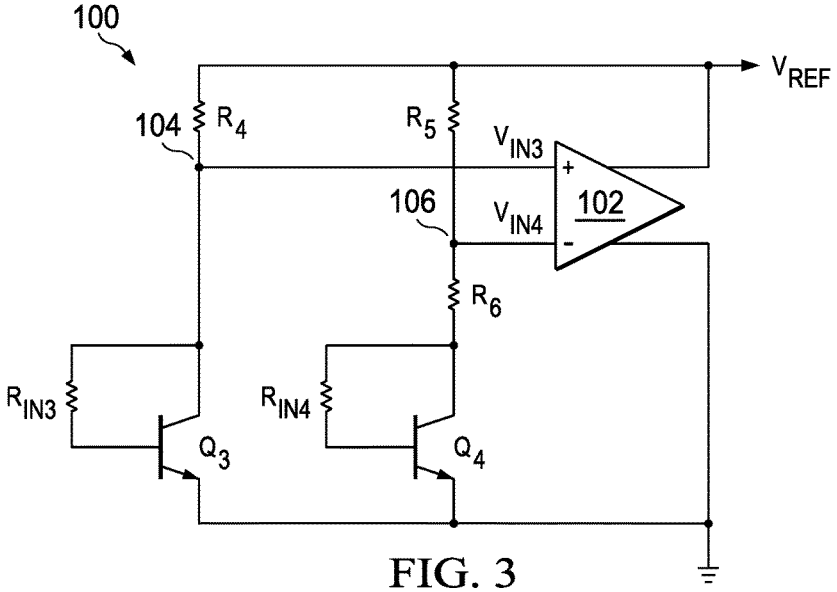
FIG. 3 illustrates another example of a reference voltage generator circuit.

FIG. 3 illustrates another example of a reference voltage generator circuit 100. The reference voltage generator circuit 100 can correspond to the reference voltage generator system 10, and is thus demonstrated as a second example of the reference voltage generator system 10.

The reference voltage generator circuit 100 includes an amplifier 102 arranged as an OP-AMP that is configured to generate the reference voltage $V_{REF}$ with reference to a low-voltage rail, demonstrated in the example of FIG. 3 as ground. The amplifier 102 receives a first input voltage $V_{IN3}$ on a node 104 at a non-inverting input and a second input voltage $V_{IN4}$ on a node 106 at an inverting input. The node 104 is arranged between a resistor $R_4$ and a collector of a first input transistor $Q_3$, demonstrated in the example of FIG. 3 as an NPN-type BJT. The node 106 is arranged between a resistor $R_5$ and a resistor $R_6$, with the resistor $R_6$ interconnecting the node 106 and a collector of a second input transistor $Q_4$, demonstrated in the example of FIG. 3 as an NPN-type BJT. The input transistors $Q_3$ and $Q_4$ each have emitters that are coupled to the low-voltage rail. As an example, the input transistors $Q_3$ and $Q_4$ can have sizes that differ with respect to each other to achieve a desired gain of the reference voltage $V_{REF}$. The resistors $R_4$ and $R_5$ interconnect the reference voltage $V_{REF}$ and the respective nodes 104 and 106. Therefore, the amplifier 102 is demonstrated in the example of FIG. 3 in a feedback arrangement, such that the reference voltage $V_{REF}$ provided at an output of the amplifier 102 is implemented to set the input voltages $V_{IN3}$ and $V_{IN4}$ at the respective inputs of the amplifier 102.

In the example of FIG. 3, the input transistors $Q_3$ and $Q_4$ are each demonstrated as diode-connected, such that the base of each of the input transistors $Q_3$ and $Q_4$ are coupled to the collector of each of the input transistors $Q_3$ and $Q_4$. Therefore, the input transistors $Q_3$ and $Q_4$ are statically biased to provide a substantially static activation of the respective $Q_3$ and $Q_4$ to provide current flow through the input transistors $Q_3$ and $Q_4$. Additionally, in the example of FIG. 3, the input transistor $Q_3$ includes an input resistor $R_{IN3}$ that is coupled in series with the base to interconnect the base and the collector of the input transistor $Q_3$. Similarly, the input transistor $Q_4$ includes an input resistor $R_{IN4}$ that is coupled in series with the base to interconnect the base and the collector of the input transistor $Q_4$. Therefore, the diode-connection of the input transistors $Q_3$ and $Q_4$ is via the respective input resistors $R_{IN3}$ and $R_{IN4}$.

Similar to as described previously regarding the example of FIG. 2, based on the input resistors $R_{IN3}$ and $R_{IN4}$ being coupled in series with the base of the respective input transistors $Q_3$ and $Q_4$, the reference voltage generator circuit 100 can compensate for errors based on controlling the emitter current $I_e$ instead of the collector current $I_c$. For example, a base-emitter voltage $V_{be}$ can be controlled based on the emitter current $I_e$ instead of the collector current $I_c$, such as demonstrated in Equations 2-4. Since the error term associated with the base current $I_b$ in the calculation of the base-emitter voltage $V_{be}$ can contribute to error effects based on transistor β, base current shot noise, flicker noise, and/or burst noise, the error effects can be substantially mitigated based on controlling the emitter current $I_e$ instead of the collector current $I_c$ in response to implementing the input resistors $R_{IN3}$ and $R_{IN4}$. Accordingly, the inclusion of the input resistors $R_{IN3}$ and $R_{IN4}$ in the reference voltage generator circuit 100 can substantially mitigate low frequency noise in the reference voltage $V_{REF}$, resulting in a more stable reference voltage $V_{REF}$.

Figure 4:
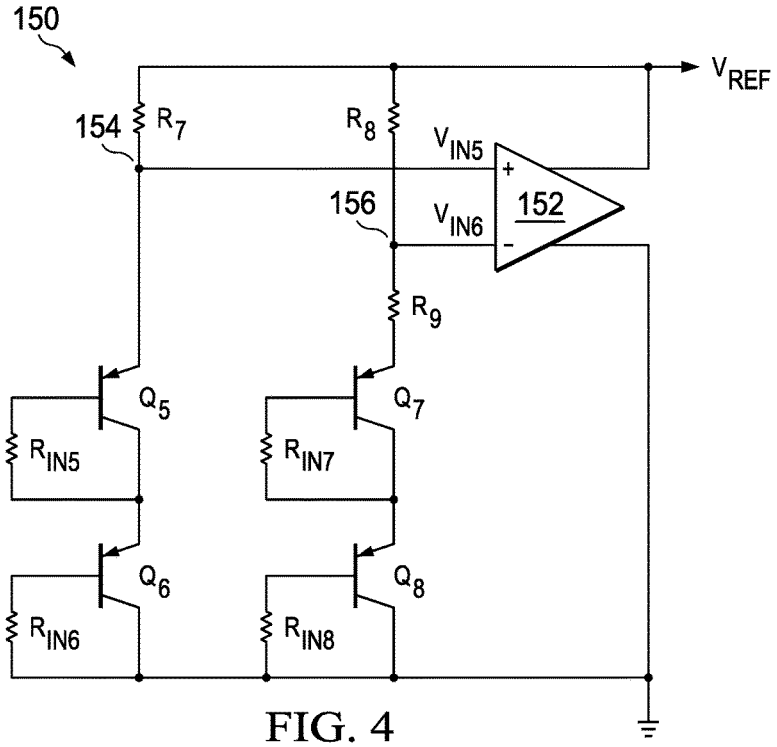
FIG. 4 illustrates yet another example of a reference voltage generator circuit.

FIG. 4 illustrates yet another example of a reference voltage generator circuit 150. The reference voltage generator circuit 150 can correspond to the reference voltage generator system 10, and is thus demonstrated as a third example of the reference voltage generator system 10.

The reference voltage generator circuit 150 includes an amplifier 152 arranged as an OP-AMP that is configured to generate the reference voltage $V_{REF}$ with reference to a low-voltage rail, demonstrated in the example of FIG. 4 as ground. The amplifier 152 receives a first input voltage $V_{IN5}$ on a node 154 at a non-inverting input and a second input voltage $V_{IN6}$ on a node 156 at an inverting input. The node 154 is arranged between a resistor $R_7$ and an emitter of a first input transistor $Q_5$ that is coupled in series with a second input transistor $Q_6$. The node 156 is arranged between a resistor $R_8$ and a resistor $R_9$, with the resistor $R_9$ interconnecting the node 156 and an emitter of a third input transistor $Q_7$ that is coupled in series with a fourth input transistor $Q_8$. In the example of FIG. 4, the input transistors $Q_5$, $Q_6$, $Q_7$, and $Q_8$ are each demonstrated in the example of FIG. 4 as PNP-type BJTs. The input transistors $Q_6$ and $Q_8$ each have collectors that are coupled to the low-voltage rail. As an example, the input transistors $Q_6$ and $Q_8$ can be substrate-coupled BJTs, and the input transistors $Q_5$ and $Q_6$ can have sizes that differ with respect to the input transistors $Q_7$ and $Q_8$ to achieve a desired gain of the reference voltage $V_{REF}$. The resistors $R_7$ and $R_8$ interconnect the reference voltage $V_{REF}$ and the respective nodes 154 and 156. Therefore, the series-connected input transistors $Q_5$ and $Q_6$ can set an amplitude of the input voltage $V_{IN5}$ based on the current flow of the input transistors $Q_5$ and $Q_6$ along with the resistor $R_7$. Similarly, the series-connected input transistors $Q_7$ and $Q_8$ can set an amplitude of the input voltage $V_{IN6}$ based on the current flow of the input transistors $Q_7$ and $Q_8$ along with the resistors $R_8$ and $R_9$. Therefore, the amplifier 152 is demonstrated in the example of FIG. 4 in a feedback arrangement similar to the examples of FIGS. 2 and 3.

In the example of FIG. 4, the input transistors $Q_5$, $Q_6$, $Q_7$, and $Q_8$ are each demonstrated as diode-connected, such that the base of each of the input transistors $Q_5$, $Q_6$, $Q_7$, and $Q_8$ are coupled to the collector of each of the input transistors $Q_5$, $Q_6$, $Q_7$, and $Q_8$. Therefore, the input transistors $Q_5$, $Q_6$, $Q_7$, and $Q_8$ are statically biased to provide a substantially static activation of the respective $Q_5$, $Q_6$, $Q_7$, and $Q_8$ to provide current flow through the input transistors $Q_5$, $Q_6$, $Q_7$, and $Q_8$. Additionally, in the example of FIG. 4, the input transistor $Q_5$ includes an input resistor $R_{IN5}$ that is coupled in series with the base to interconnect the base and the collector of the input transistor $Q_5$, and the input transistor $Q_6$ includes an input resistor $R_{IN6}$ that is coupled in series with the base to interconnect the base and the collector of the input transistor $Q_6$. Similarly, the input transistor $Q_7$ includes an input resistor $R_{IN7}$ that is coupled in series with the base to interconnect the base and the collector of the input transistor $Q_7$, and the input transistor $Q_8$ includes an input resistor $R_{IN8}$ that is coupled in series with the base to interconnect the base and the collector of the input transistor $Q_8$. Therefore, the diode-connection of the input transistors $Q_5$, $Q_6$, $Q_7$, and $Q_8$ is via the respective input resistors $R_{IN5}$, $R_{IN6}$, $R_{IN7}$, and $R_{IN8}$.

Similar to as described previously regarding the example of FIG. 2, based on the input resistors $R_{IN5}$, $R_{IN6}$, $R_{IN7}$, and $R_{IN8}$ being coupled in series with the base of the respective input transistors $Q_5$, $Q_6$, $Q_7$, and $Q_8$, the reference voltage generator circuit 150 can compensate for errors based on controlling the emitter current $I_e$ instead of the collector current $I_c$. For example, a base-emitter voltage $V_{be}$ can be controlled based on the emitter current $I_e$ instead of the collector current $I_c$, such as demonstrated in Equations 2-4. Since the error term associated with the base current $I_b$ in the calculation of the base-emitter voltage $V_{be}$ can contribute to error effects based on transistor β, base current shot noise, flicker noise, and/or burst noise, the error effects can be substantially mitigated based on controlling the emitter current $I_e$ instead of the collector current $I_c$ in response to implementing the input resistors $R_{IN5}$, $R_{IN6}$, $R_{IN7}$, and $R_{IN8}$. Accordingly, the inclusion of the input resistors $R_{IN5}$, $R_{IN6}$, $R_{IN7}$, and $R_{IN8}$ in the reference voltage generator circuit 150 can substantially mitigate low frequency noise in the reference voltage $V_{REF}$, resulting in a more stable reference voltage $V_{REF}$.

Figure 5:
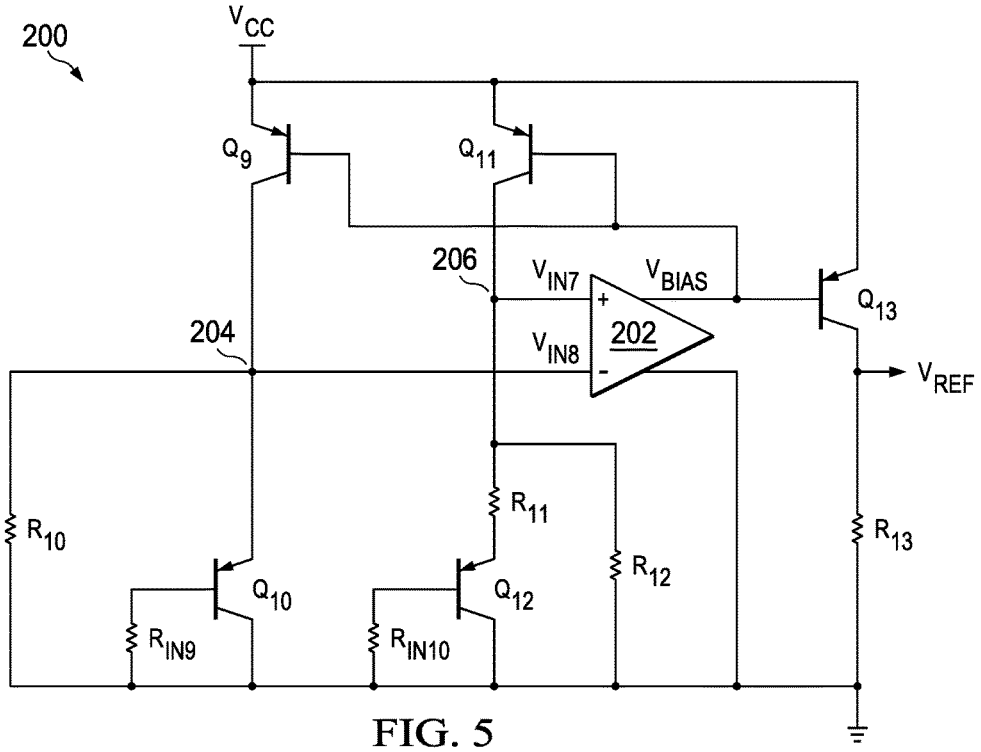
FIG. 5 illustrates yet a further example of a reference voltage generator circuit.

FIG. 5 illustrates yet a further example of a reference voltage generator circuit 200. The reference voltage generator circuit 200 can correspond to the reference voltage generator system 10, and is thus demonstrated as a fourth example of the reference voltage generator system 10.

The reference voltage generator circuit 200 includes an amplifier 202 arranged as an OP-AMP that is configured to generate a voltage $V_{BIAS}$ with reference to a low-voltage rail, demonstrated in the example of FIG. 5 as ground. The amplifier 202 receives a first input voltage $V_{IN7}$ on a node 204 at a non-inverting input and a second input voltage $V_{IN8}$ on a node 206 at an inverting input. The node 204 is arranged between a collector of a transistor $Q_9$ and an emitter of a first input transistor $Q_{10}$, as well as a resistor $R_{10}$ that interconnects the node 204 and the low-voltage rail. The node 206 is arranged between a collector of a transistor $Q_{11}$ and a resistor $R_{11}$, with the resistor $R_{11}$ interconnecting the node 206 and an emitter of a second input transistor $Q_{12}$, as well as a resistor $R_{12}$ that interconnects the node 206 and the low-voltage rail. In the example of FIG. 5, the transistors $Q_9$ and $Q_{11}$ and the input transistors $Q_{10}$ and $Q_{12}$ are each demonstrated in the example of FIG. 5 as PNP-type BJTs. The input transistors $Q_{10}$ and $Q_{12}$ each have collectors that are coupled to the low-voltage rail. As an example, the input transistors $Q_{10}$ and $Q_{12}$ can be substrate-coupled BJTs, and the input transistors $Q_{10}$ and $Q_{12}$ can have sizes that differ with respect to each other to achieve a desired gain of the reference voltage $V_{REF}$.

The transistors $Q_9$ and $Q_{11}$ interconnect a power voltage $V_{CC}$ at an emitter and the respective nodes 204 and 206 at a collector, and are controlled by the bias voltage $V_{BIAS}$ at a respective base. Additionally, the bias voltage $V_{BIAS}$ controls an output transistor $Q_{13}$ that interconnects the power voltage $V_{CC}$ at an emitter and an output node 208 at a collector. As an example, the output transistor $Q_{13}$ can be fabricated as a matched component with respect to the transistors $Q_9$ and $Q_{11}$. A resistor $R_{13}$ interconnects the output node 208 and the low-voltage rail, such that the output transistor $Q_{13}$ generates the reference voltage $V_{REF}$ on the output node 208. Therefore, the input transistor $Q_{10}$ can set an amplitude of the input voltage $V_{IN7}$ based on the resistance across the input transistor $Q_{10}$ along with the transistor $Q_9$. Similarly, the input transistor $Q_{12}$ can set an amplitude of the input voltage $V_{IN8}$ based on the resistance across the input transistor $Q_{12}$ along with the resistor $R_{11}$ and the transistor $Q_{11}$. Therefore, the amplifier 202 is demonstrated in the example of FIG. 5 in a feedback arrangement based on the control of the transistors $Q_9$ and $Q_{11}$ via the bias voltage $V_{BIAS}$ generated by the amplifier. In the example of FIG. 5, the current ratio of the input transistors $Q_{10}$ and $Q_{12}$ is set by the transistors $Q_9$ and $Q_{11}$ and the $V_{be}$ voltage of the input transistors $Q_{10}$ and $Q_{12}$ is converted to current by the resistors $R_{10}$ and $R_{12}$. Thus, when the current through the resistor $R_{11}$ (e.g., $(\Delta V_{be})/R$) is summed with the current through the resistor $R_{12}$ (e.g., $V_{be}/R$), the summed current through a resistor of same type (e.g., the resistor $R_{13}$ in the example of FIG. 5) and through the current mirror transistor $Q_{13}$ results in the reference voltage $V_{REF}$ being substantially constant with temperature (e.g., based also on the fabrication of the transistors $Q_9$ and $Q_{11}$ and the output transistor $Q_{13}$ as matched components). While the transistors demonstrated in the reference voltage generator system 200 (e.g., the transistors $Q_9$, $Q_{11}$, and $Q_{13}$) are demonstrated as PNP-type BJT transistors, it is to be understood that the reference voltage generator system 200 could instead include other types of transistors, such as P-type metal oxide semiconductor field-effect transistors (MOSFETs).

In the example of FIG. 5, the input transistors $Q_{10}$ and $Q_{12}$ are each demonstrated as diode-connected, such that the base of each of the input transistors $Q_{10}$ and $Q_{12}$ are coupled to the collector of each of the input transistors $Q_{10}$ and $Q_{12}$. Therefore, the input transistors $Q_{10}$ and $Q_{12}$ are statically biased to provide a substantially static activation of the respective $Q_{10}$ and $Q_{12}$ to provide current flow through the input transistors $Q_{10}$ and $Q_{12}$. Additionally, in the example of FIG. 5, the input transistor $Q_{10}$ includes an input resistor $R_{IN9}$ that is coupled in series with the base to interconnect the base and the collector of the input transistor $Q_{10}$, and the input transistor $Q_{12}$ includes an input resistor $R_{IN10}$ that is coupled in series with the base to interconnect the base and the collector of the input transistor $Q_{12}$. Therefore, the diode-connection of the input transistors $Q_{10}$ and $Q_{12}$ is via the respective input resistors $R_{IN9}$ and $R_{IN10}$.

Similar to as described previously regarding the example of FIG. 2, based on the input resistors $R_{IN9}$ and $R_{IN10}$ being coupled in series with the base of the respective input transistors $Q_{10}$ and $Q_{12}$, the reference voltage generator circuit 200 can compensate for errors based on controlling the emitter current $I_e$ instead of the collector current $I_c$. For example, a base-emitter voltage $V_{be}$ can be controlled based on the emitter current $I_e$ instead of the collector current $I_c$, such as demonstrated in Equations 2-4. Since the error term associated with the base current $I_b$ in the calculation of the base-emitter voltage $V_{be}$ can contribute to error effects based on transistor β, base current shot noise, flicker noise, and/or burst noise, the error effects can be substantially mitigated based on controlling the emitter current $I_e$ instead of the collector current $I_c$ in response to implementing the input resistors $R_{IN9}$ and $R_{IN10}$. Accordingly, the inclusion of the input resistors $R_{IN9}$ and $R_{IN10}$ in the reference voltage generator circuit 200 can substantially mitigate low frequency noise in the reference voltage $V_{REF}$, resulting in a more stable reference voltage $V_{REF}$.

While the systems and principles described herein are with reference to a reference voltage generator (e.g., a bandgap voltage generator), it is to be understood that the inclusion of the resistor in series with the base of the input transistors is not limited to the circuits described herein. For example, any of a variety of other circuits can implement input voltage control of an amplifier in a manner that it is substantially insensitive to temperature variations and which substantially mitigates noise sources, such as shot noise, flicker noise, and/or burst noise. As an example, a temperature sensor can implement an amplifier having input voltages that are controlled via input transistors (e.g., BJT transistors) having series-connected resistors to implement control of a base-emitter voltage $V_{be}$ based on the emitter current $I_e$ instead of the collector current $I_c$, such as demonstrated in Equations 2-4. Therefore, the circuits described herein can be implemented for a variety of applications.

What have been described above are examples of the invention. It is, of course, not possible to describe every conceivable combination of components or method for purposes of describing the invention, but one of ordinary skill in the art will recognize that many further combinations and permutations of the invention are possible. As used herein, the term "based on" means based at least in part on. Additionally, where the disclosure or claims recite "a," "an," "a first," or "another" element, or the equivalent thereof, it should be interpreted to include one or more than one such element, neither requiring nor excluding two or more such elements. Accordingly, the invention is intended to embrace all such alterations, modifications, and variations that fall within the scope of this application, including the appended claims.

What is claimed is:

1. A reference voltage generator system comprising:

an amplifier configured to generate a reference voltage based on a respective input voltage provided at each of at least one input of the amplifier; and at least one input transistor configured as a bipolar junction transistor (BJT) and coupled to the at least one input of the amplifier, the at least one input transistor biased to conduct a current to set an amplitude of the respective input voltage provided at each of the at least one input of the amplifier, each of the at least one input transistor comprising a base terminal that is coupled in series with an input resistor, wherein a resistance value $R_b$ of the input resistor is selected based on:

$$R_b = \frac{-V_T \ln\left[1 - \frac{I_b}{I_e}\right]}{I_b},$$

where:

$V_T$ is a thermal voltage associated with the at least one input transistor, $I_b$ is a base current associated with the at least one input transistor, and $I_e$ is an emitter current associated with the at least one input transistor.

2. The system of claim 1, wherein each of the at least one input transistor is biased to conduct the current based on being diode-connected, such that the input resistor interconnects the base terminal and a second terminal of each respective one of the at least one input transistor.

3. The system of claim 1, wherein the BJT input transistor is a substrate-coupled BJT.

4. The system of claim 1, wherein the at least one input transistor comprises:

a first input transistor comprising a first terminal that is coupled to a low-voltage rail and a second terminal that is coupled to a first input of the amplifier; and a second input transistor comprising a first terminal that is coupled to the low-voltage rail and a second terminal that is coupled to a second input of the amplifier via an interconnecting resistor.

5. The system of claim 4, wherein the interconnecting resistor is a first interconnecting resistor, the system further comprising:

a second interconnecting resistor interconnecting the second input of the amplifier and the reference voltage, such that the first and second interconnecting resistors form a voltage-divider; and a third interconnecting resistor interconnecting the first input of the amplifier and the reference voltage.

6. The system of claim 1, wherein the at least one input transistor comprises:

a first pair of input transistors that are coupled in series with respect to each other to conduct a first current to set an amplitude of a first input voltage provided to a first input of the amplifier, each of the first pair of input transistors comprising a base terminal that is coupled in series with a respective input resistor; and a second pair of input transistors that are coupled in series with respect to each other to conduct a second current to set an amplitude of a second input voltage provided to a second input of the amplifier, each of the second pair of input transistors comprising a base terminal that is coupled in series with another respective input resistor.

7. The system of claim 1, further comprising:

an output transistor that is controlled by an output of the amplifier, the output transistor interconnecting a power voltage node and an output node on which the reference voltage is generated, the reference voltage generated based on an output current flowing through the output transistor; and at least one feedback transistor that is controlled by the output of the amplifier, the at least one feedback transistor interconnecting the power voltage node and the respective at least one input of the amplifier to provide the input voltage at the respective at least one input of the amplifier in a feedback arrangement.

8. The system of claim 1, wherein the resistance value of the input resistor is selected based on an error term of a current associated with the base terminal of the respective at least one input transistor, the current associated with the base terminal being associated with an activation voltage of the at least one input transistor to set the amplitude of the respective input voltage.

9. The system of claim 1 further comprising:

at least one feedback circuit component associated with a feedback arrangement of the amplifier to set the amplitude of the at least one input voltage, wherein the at least one input transistor is configured to conduct a proportional-to-absolute-temperature (PTAT) current, and wherein the at least one feedback circuit component is fabricated as a matched component of the at least one input resistor or the at least one input transistor, such that the reference voltage is substantially insensitive to temperature variation.

10. A reference voltage generator system comprising:

an amplifier configured to generate a reference voltage based on a respective input voltage provided at each of at least one input of the amplifier; and at least one input bipolar junction transistor (BJT) that is coupled to the at least one input of the amplifier and is biased to conduct a proportional-to-absolute-temperature (PTAT) current to set an amplitude of the respective input voltage provided at each of the at least one input of the amplifier, each of the at least one input BJT comprising an input resistor interconnecting a base terminal and a collector terminal of the respective at least one input BJT, wherein a resistance value $R_b$ of the input resistor is selected based on:

$$R_b = \frac{-V_T \ln\left[1 - \frac{I_b}{I_e}\right]}{I_b},$$

where:

$V_T$ is a thermal voltage associated with the at least one BJT, $I_b$ is a base current associated with the at least one BJT, and $I_e$ is an emitter current associated with the at least one BJT.

11. The system of claim 10, wherein the at least one input BJT comprises:

a first input BJT comprising a base terminal that is coupled to a low-voltage rail and an emitter terminal that is coupled to a first input of the amplifier; and a second input BJT comprising a base terminal that is coupled to the low-voltage rail and an emitter terminal that is coupled to a second input of the amplifier via an interconnecting resistor.

12. The system of claim 11, further comprising:

an output transistor that is controlled by an output of the amplifier, the output transistor interconnecting a power voltage node and an output node on which the reference voltage is generated, the reference voltage generated based on an output current flowing through the output transistor; and at least one feedback transistor that is controlled by the output of the amplifier, the at least one feedback transistor interconnecting the power voltage node and the respective at least one input of the amplifier to provide the input voltage at the respective at least one input of the amplifier in a feedback arrangement.

13. The system of claim 11, wherein the resistance value of the input resistor is selected based on an error term of a current associated with the base terminal of the respective at least one input BJT to set an activation voltage of the at least one input BJT to set the amplitude of the respective input voltage.

14. The system of claim 10, wherein the at least one input BJT comprises:

a first pair of input BJTs that are coupled in series with respect to each other to conduct a first current to set an amplitude of a first input voltage provided to a first input of the amplifier, each of the first pair of input BJTs comprising an input resistor interconnecting a base terminal and a collector terminal of each of the respective first pair of input BJTs; and a second pair of input BJTs that are coupled in series with respect to each other to conduct a second current to set an amplitude of a second input voltage provided to a second input of the amplifier, each of the second pair of input BJTs comprising an input resistor interconnecting a base terminal and a collector terminal of each of the respective second pair of input BJTs.

15. The system of claim 10, further comprising:

at least one feedback circuit component associated with a feedback arrangement of the amplifier to set the amplitude of the at least one input voltage, the at least one feedback circuit component being fabricated as a matched component of the at least one input resistor or the at least one input BJT such that the reference voltage is substantially insensitive to temperature variation.

16. A reference voltage generator system comprising:

an amplifier configured to generate a reference voltage based on a respective input voltage provided at each of two inputs of the amplifier;

a first input transistor coupled to the first input of the amplifier, the first input transistor biased to conduct a current for setting an amplitude of the respective input voltage provided at the first input of the amplifier, the first input transistor comprising an input terminal coupled in series with a first input resistor, a current passing through the first input resistor is same as a current passing through the input terminal of the first input transistor; and a second input transistor coupled to the second input of the amplifier, the second input transistor biased to conduct a current for setting an amplitude of the respective input voltage provided at the second input of the amplifier, the second input transistor comprising an input terminal coupled in series with a second input resistor, a current passing through the second input resistor is same as a current passing through the input terminal of the second input transistor, the first input resistor and the second input resistor having substantially similar second-order temperature coefficient.

17. The system of claim 16, wherein each of the input terminals of the first and second input transistors is a first input terminal of the first and second input transistors, and wherein the first transistor is biased to conduct the current based on being diode-connected such that the first input resistor interconnects the first input terminal of the first input transistor and a second terminal of the first input transistor, and wherein the second transistor is biased to conduct the current based on being diode-connected such that the second input resistor interconnects the first input terminal of the second input transistor and a second terminal of the second input transistor.

18. The system of claim 16, wherein each of the first and second input transistors is configured as a bipolar junction transistor (BJT) comprising a base terminal that is coupled in series with each of the first and second input resistors respectively.

19. The system of claim 18, wherein a resistance value $R_b$ for each of the first and second input resistors is selected based on:

$$R_b = \frac{-V_T \ln\left[1 - \frac{I_b}{I_e}\right]}{I_b},$$

where:

$V_T$ is a thermal voltage associated with each of the first and second input transistors respectively, $I_b$ is a base current associated with each of the first and second input transistors respectively, and $I_e$ is an emitter current associated with each of the first and second input transistors respectively.

20. The system of claim 16, wherein the first input resistor has substantially similar first-order temperature coefficient as that of the second input resistor.

* * * * *